US009719227B2

(12) United States Patent
Martin et al.

(10) Patent No.: US 9,719,227 B2
(45) Date of Patent: Aug. 1, 2017

(54) SELF-LOCKING ATTACHMENT COUPLER

(71) Applicant: 1708828 ONTARIO LIMITED, Listowel (CA)

(72) Inventors: Marvin Dale Martin, Linwood (CA); Ryan Frey, Listowel (CA)

(73) Assignee: 1708828 ONTARIO LIMITED, Listowel, Ontario (CA)

( * ) Notice: Subject to any disclaimer, the term of this patent is extended or adjusted under 35 U.S.C. 154(b) by 218 days.

(21) Appl. No.: 14/479,876

(22) Filed: Sep. 8, 2014

(65) Prior Publication Data

US 2015/0068073 A1 Mar. 12, 2015

(30) Foreign Application Priority Data

Sep. 6, 2013 (GB) ..... 1315938.9

(51) Int. Cl.
*E02F 3/36* (2006.01)

(52) U.S. Cl.
CPC ..... *E02F 3/3631* (2013.01); *E02F 3/3636* (2013.01); *E02F 3/3645* (2013.01); *E02F 3/3663* (2013.01); *E02F 3/3668* (2013.01); *E02F 3/3672* (2013.01)

(58) Field of Classification Search
CPC ..... E02F 3/3631; E02F 3/3636; E02F 3/3645; E02F 3/3668; E02F 3/3672
See application file for complete search history.

(56) References Cited

U.S. PATENT DOCUMENTS

| | | | | |
|---|---|---|---|---|
| 3,985,249 | A | 10/1976 | Aker et al. | |
| 4,067,467 | A | 1/1978 | Datta et al. | |
| 4,208,163 | A | 6/1980 | Holmqvist | |
| 4,214,840 | A | 7/1980 | Beales | |
| 4,243,356 | A | 1/1981 | Takojima | |
| 4,452,560 | A | 6/1984 | Coyle et al. | |
| 4,787,811 | A | 11/1988 | Langenfeld et al. | |
| 5,078,569 | A * | 1/1992 | Cook | E02F 3/3636 414/685 |
| 5,224,816 | A | 7/1993 | Kaczmarczyk et al. | |
| 5,263,810 | A | 11/1993 | Takekata et al. | |
| 5,419,673 | A * | 5/1995 | Merhar | E02F 3/3631 172/272 |
| 5,431,528 | A | 7/1995 | Jenkins et al. | |
| 5,466,113 | A | 11/1995 | Norberg | |

(Continued)

FOREIGN PATENT DOCUMENTS

FR 2993584 1/2014

*Primary Examiner* — Matthew D Troutman
(74) *Attorney, Agent, or Firm* — Anthony Asquith Corp.

(57) ABSTRACT

The coupler is mounted on the end of the boom of a boom-tractor, and provides secure locking-in of a bucket. The coupler having been set to its latched-open condition, the tractor is driven to the bucket so that the bottom-lug of the bucket enters the coupler, whereupon the bucket is picked up and is automatically securely locked into coupler, without and manipulation of the coupler being required of the tractor-driver other than manipulation of the boom. For setting the bucket down on the ground, after use, the driver manually pulls out a slider of the coupler. That action sets the coupler into its slider-held condition, whereby when the tractor is driven away from the bucket, the coupler is automatically left set in the said latched-open condition.

11 Claims, 6 Drawing Sheets

(56) References Cited

U.S. PATENT DOCUMENTS

| | | | | |
|---|---|---|---|---|
| RE37,320 | E | 8/2001 | Horton | |
| 6,336,785 | B1 | 1/2002 | Kunzman | |
| 6,499,904 | B2 | 12/2002 | Nye | |
| 6,991,398 | B2 | 1/2006 | Leemans et al. | |
| 6,994,511 | B2 | 2/2006 | Westendorf et al. | |
| 7,001,136 | B2 | 2/2006 | Perrin et al. | |
| 7,001,137 | B2 | 2/2006 | Perrin et al. | |
| 7,086,821 | B1 | 8/2006 | Reicks | |
| 7,467,918 | B2 | 12/2008 | Yao et al. | |
| 7,478,490 | B2 | 1/2009 | Segerljung | |
| 7,654,019 | B2 | 2/2010 | Yeager et al. | |
| 7,674,085 | B2 | 3/2010 | Bystrom | |
| 8,549,775 | B2 | 10/2013 | Lanting et al. | |
| 8,777,546 | B2 | 7/2014 | Lanting et al. | |
| 8,800,179 | B2 | 8/2014 | Seda et al. | |
| 9,121,162 | B1 * | 9/2015 | Kimble | E02F 3/3636 |
| 9,342,093 | B2 * | 5/2016 | Villarreal | E02F 3/3631 |
| 2002/0071754 | A1 | 6/2002 | Fatemi | |
| 2004/0228716 | A1 * | 11/2004 | Perrin | E02F 3/3636 414/723 |
| 2005/0111953 | A1 | 5/2005 | Westendorf et al. | |
| 2007/0297888 | A1 | 12/2007 | Bystrom | |
| 2009/0191038 | A1 | 7/2009 | Morin et al. | |
| 2010/0189535 | A1 | 7/2010 | Nye et al. | |
| 2012/0189374 | A1 * | 7/2012 | Lanting | E02F 3/365 403/27 |
| 2015/0225920 | A1 | 8/2015 | Friedrich | |
| 2016/0033989 | A1 * | 2/2016 | Villarreal | E02F 3/3631 74/470 |

* cited by examiner

Fig.4
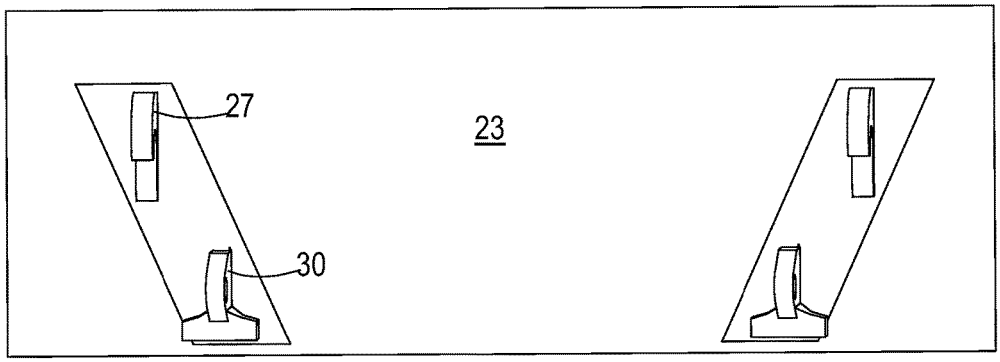
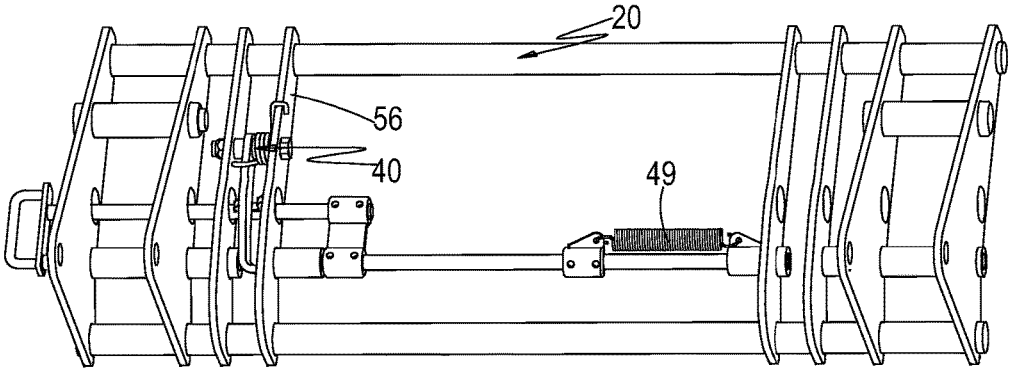
Fig.5
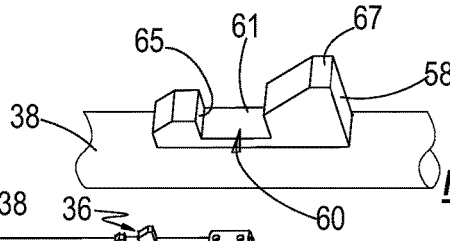
Fig.7A
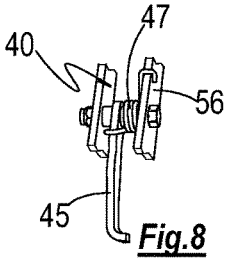
Fig.8
Fig.7
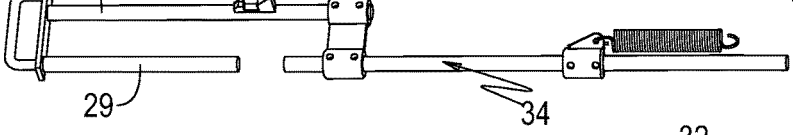
Fig.6
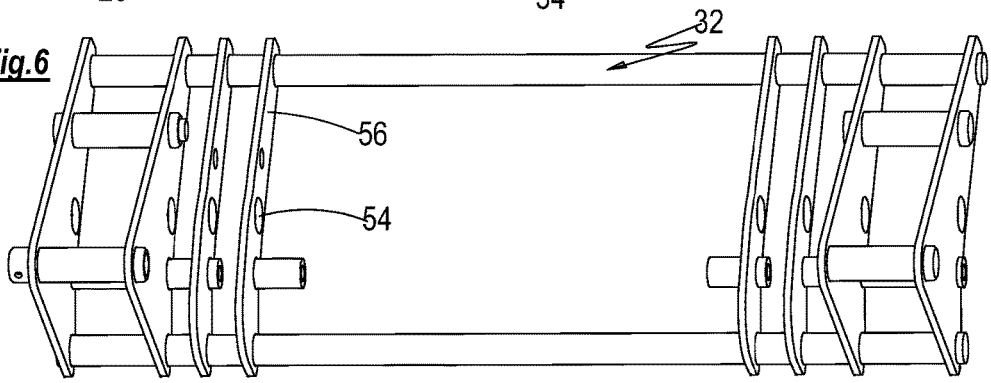

47
58
50
65
61
38
34
29

61
65
58
67
56
54
27

58
67
63
54
45
29
65
38
52
43
30
23
25
56

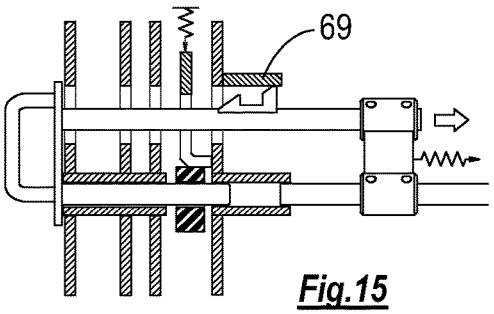
Fig.15
Fig.14
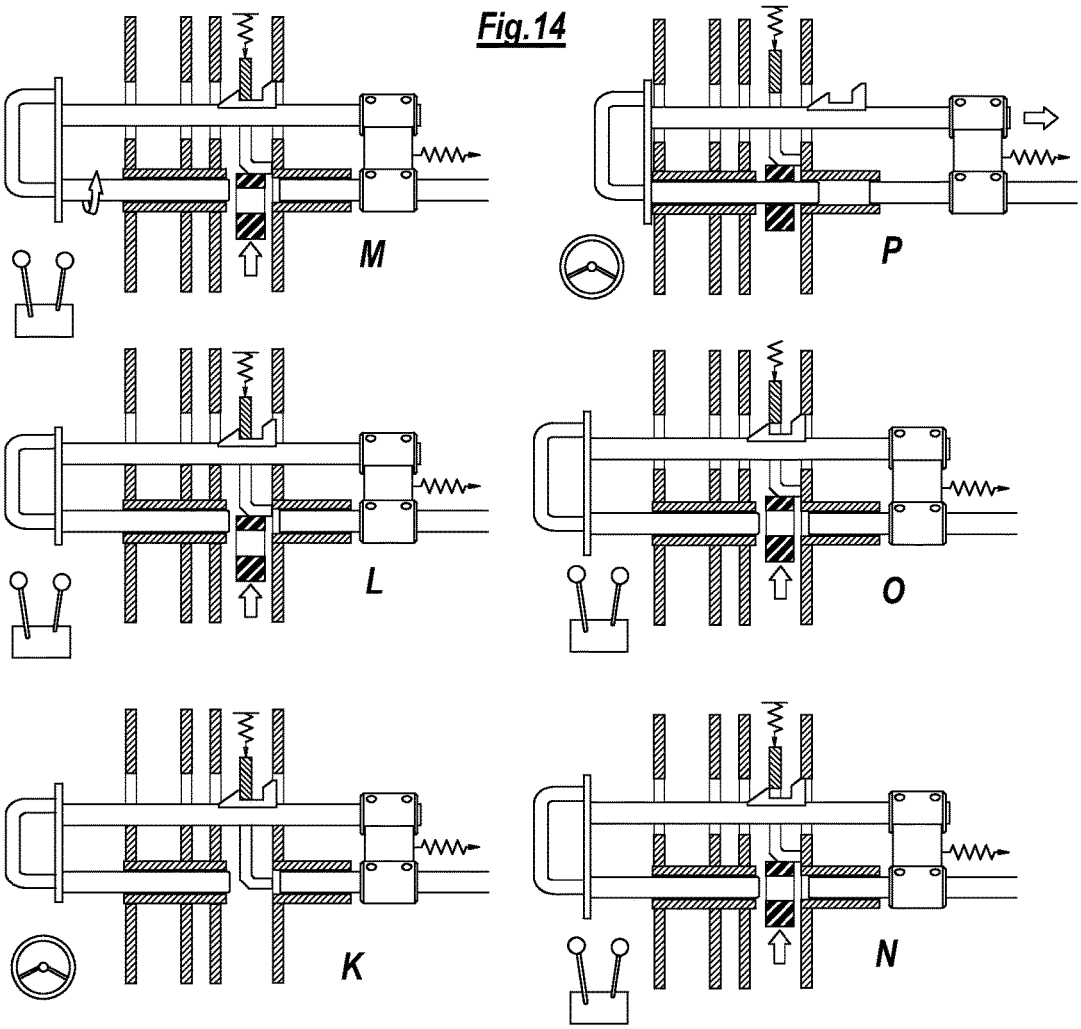

SELF-LOCKING ATTACHMENT COUPLER

This technology relates to a coupler unit for attaching an accessory such as a bucket to a manipulable boom of a tractor or the like. The coupler is fixed to the end of the boom. The driver manipulates the boom, from the cab, by manually adjusting the hydraulic servo boom-controls on the tractor.

When picking up a bucket, basically two required operations include (a) manipulating the boom so as to physically pick the bucket up off the ground and (b) locking the bucket to the boom. When uncoupling the bucket, the operations are (a) to deposit the bucket on the ground, (b) to unlock the bucket, and then (c) to withdraw the boom.

Traditionally, the task of locking the bucket to the coupler has required the driver to insert e.g. a locking-pin into a complementary socket, after the bucket has been assembled onto or into the coupler. This operation, and the operation of releasing the locking-pin, have been difficult to automate without adversely affecting the integrity of the lock. (Herein, to 'automate' the operations means to enable the operations to be carried out by the tractor-driver, from the cab of the tractor.)

An aim of the present technology is to provide a coupler in which these tasks are simplified, and in which the operational elements of the tasks are able to take place largely automatically, i.e. without the driver needing to get down from the tractor in order to perform tasks actually on the coupler.

In the present design, in order to pick up a bucket from the ground, and to lock the bucket, the operator simply engages the coupler with the hooks and lugs on the bucket. After performing this one simple action, which can be done without the driver getting down from the tractor, the bucket is left safely secured and locked to the coupler.

The technology is described as it relates to a four-point coupler, for example of the European standard configuration. The coupler may be operated with twin hydraulic rams (as in the drawings), or with one single ram. The technology can be adapted to many other coupler formats.

LIST OF DRAWINGS

Sheet 1/6:

Sheet 2/6:

FIG. 4 is a pictorial view of the back or coupler-side of the bucket.

FIG. 5 is the same view as FIG. 4, but of the coupler.

FIG. 6 is the same view as FIG. 5, but of a frame component of the coupler.

FIG. 7 is the same view as FIG. 5, but of a slider component of the coupler.

FIG. 7A is the same view as FIG. 6, but of a cam-unit component of the slider-assembly.

FIG. 8 is the same view as FIG. 5, but of a lever-assembly component of the coupler.

Figure 9:
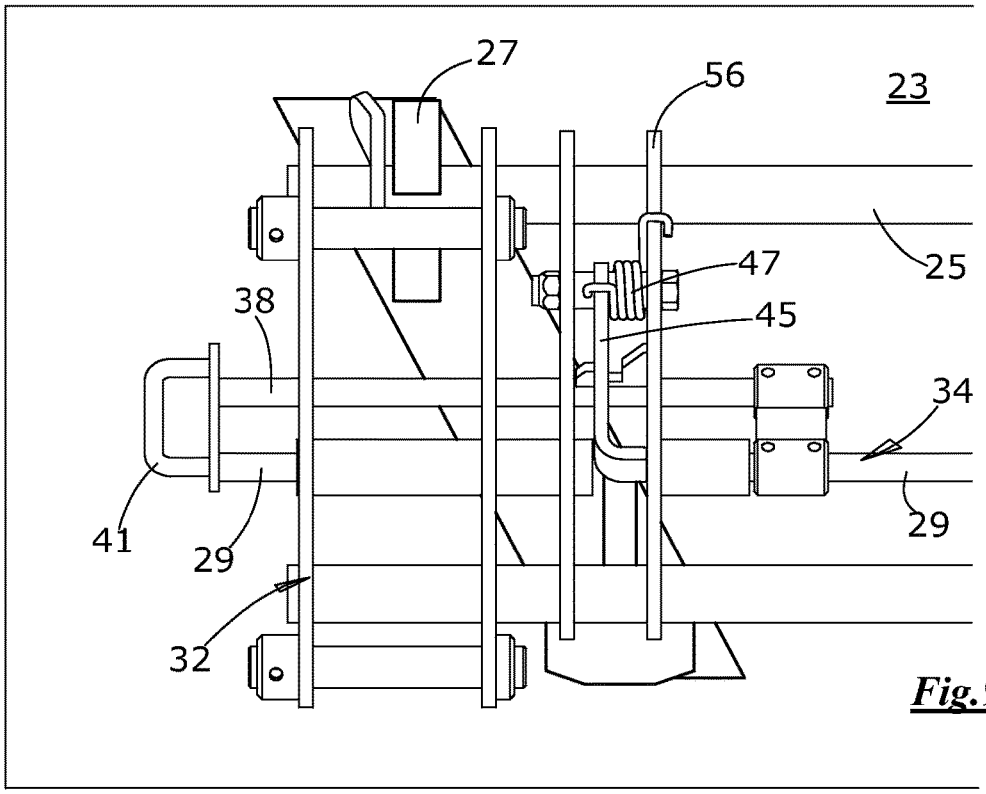

Sheet 3/6:

FIG. 9 is a front-elevation of a portion of the coupler, coupled to the bucket.

Figure 10:
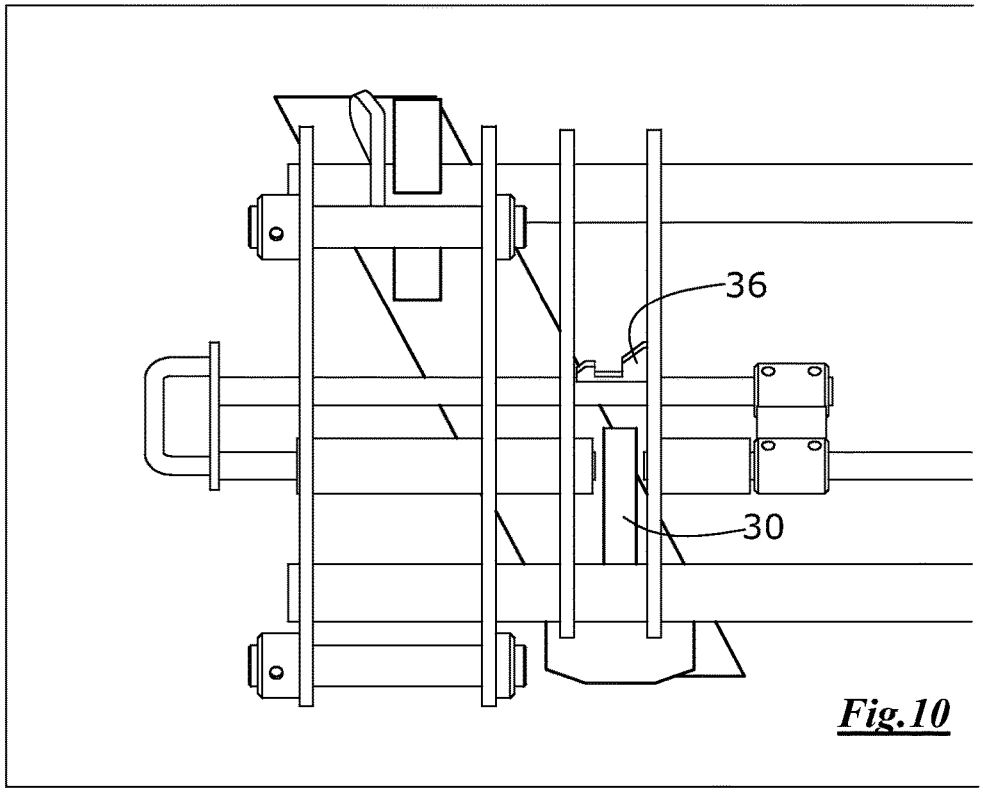

FIG. 10 is the same view as FIG. 9, but omits the lever-assembly.

Figures 11, 12A, 12B:
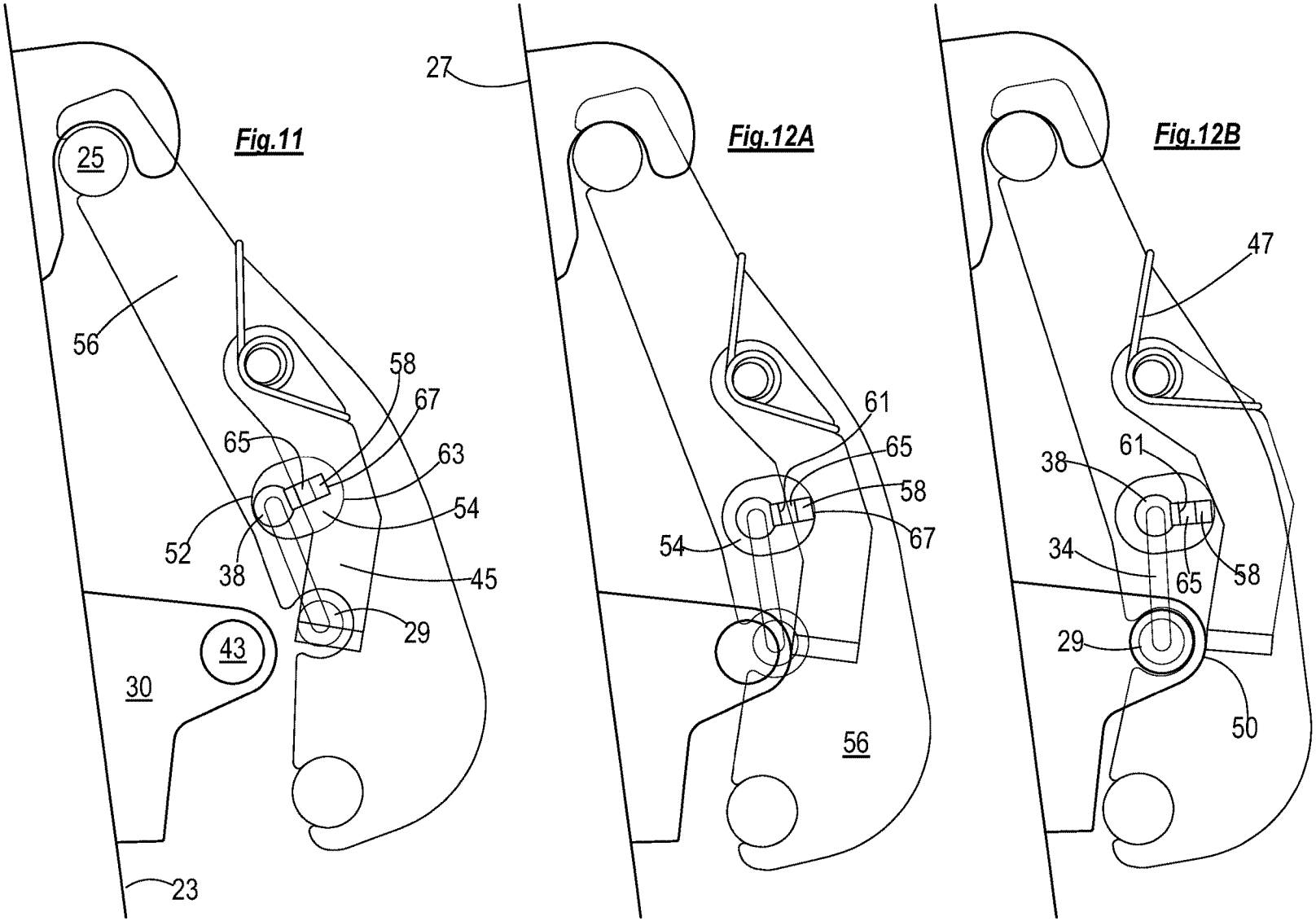

Sheet 4/6:

FIG. 11 is a diagram of the coupler, shown in its latched-open condition, ready to be coupled to a bucket. FIG. 11 shows the same condition as FIG. 2

FIG. 12A is the same diagram as FIG. 11, but shows the coupler starting to interact with the bottom-lug of the bucket.

FIG. 12B is the same diagram, but shows the coupler now in its bucket-locked-in condition, the bucket being firmly and securely attached to the coupler, and hence to the boom.

Figure 3:
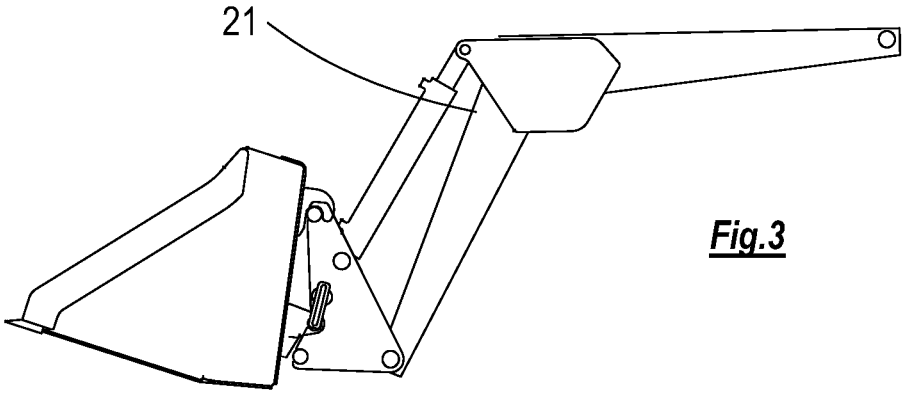
FIG. 3 is the same view as FIG. 2, except that a bottom-bucket-pin of the coupler is now engaged with a bottom-lug of the bucket.

FIG. 12B shows the same condition as FIG. 3.

Figure 13:
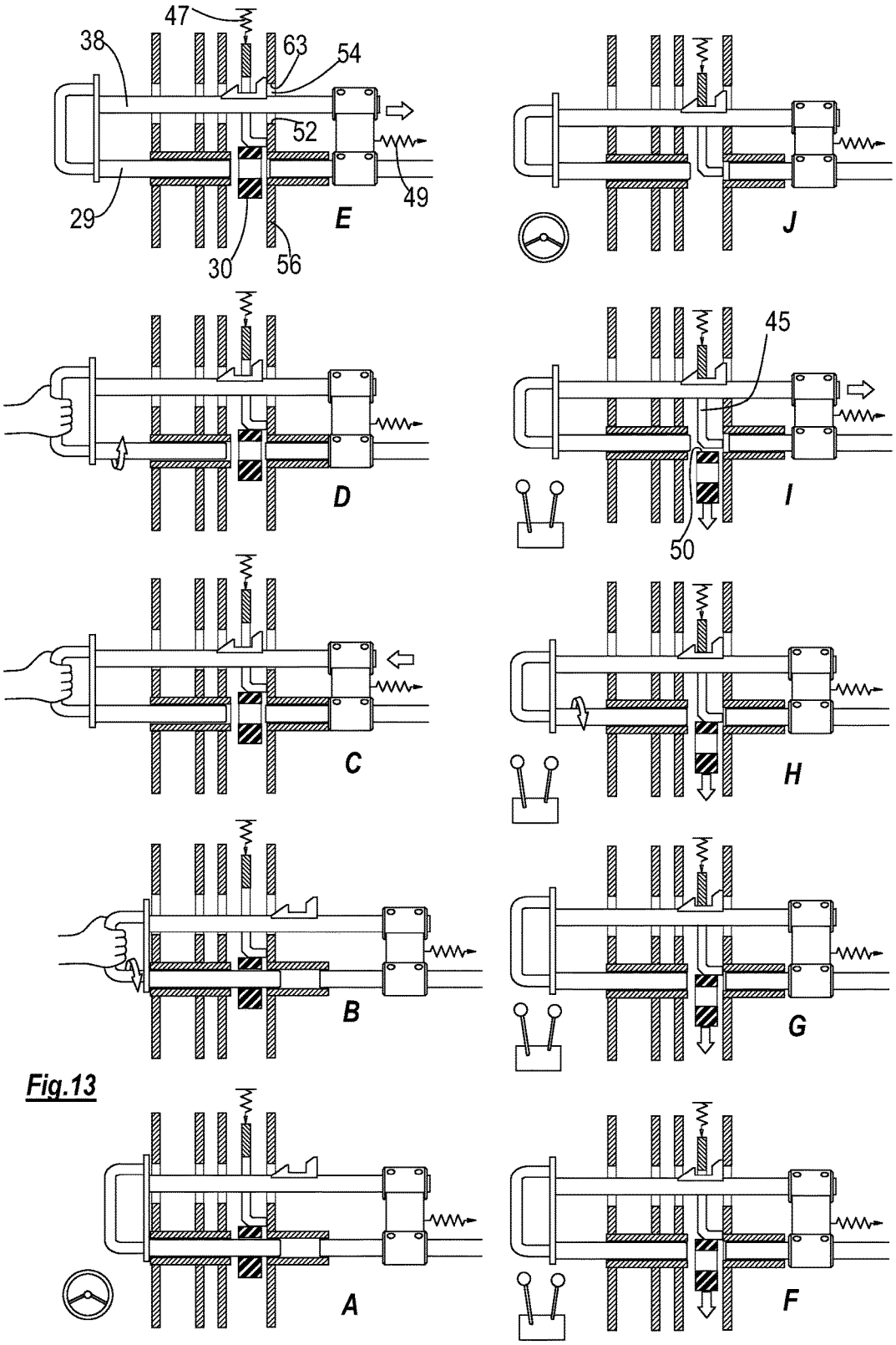

Sheet 5/6:

FIG. 13 consists of ten diagrams, designated A to J, which show different stages in the relative movements between the components of the coupler as the bucket is unlocked and released from the coupler.

Sheet 6/6:

FIG. 14 consists of six diagrams, designated K to P, which show different stages in the relative movements between the components of the coupler as the bucket is picked up and locked to the coupler.

FIG. 15 is the same view as View.P of FIG. 14, except that in FIG. 15 a guide has been added to restrict rotational movement of the slider.

Figure 1:
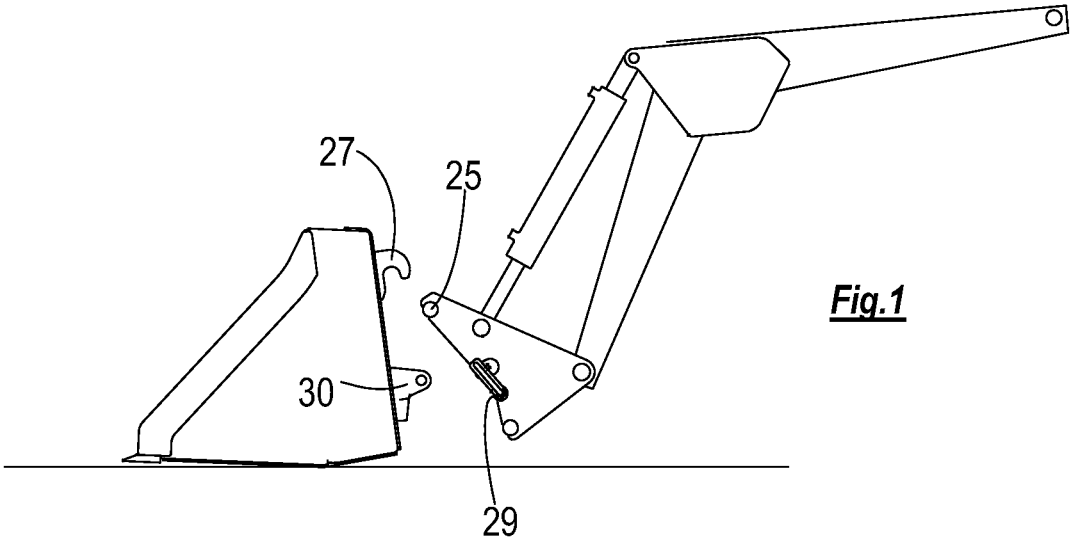
FIG. 1 is a side elevation showing a bucket, a coupler, and a manipulable boom of a tractor. The bucket is resting on the ground, detached from the coupler.
Figure 2:
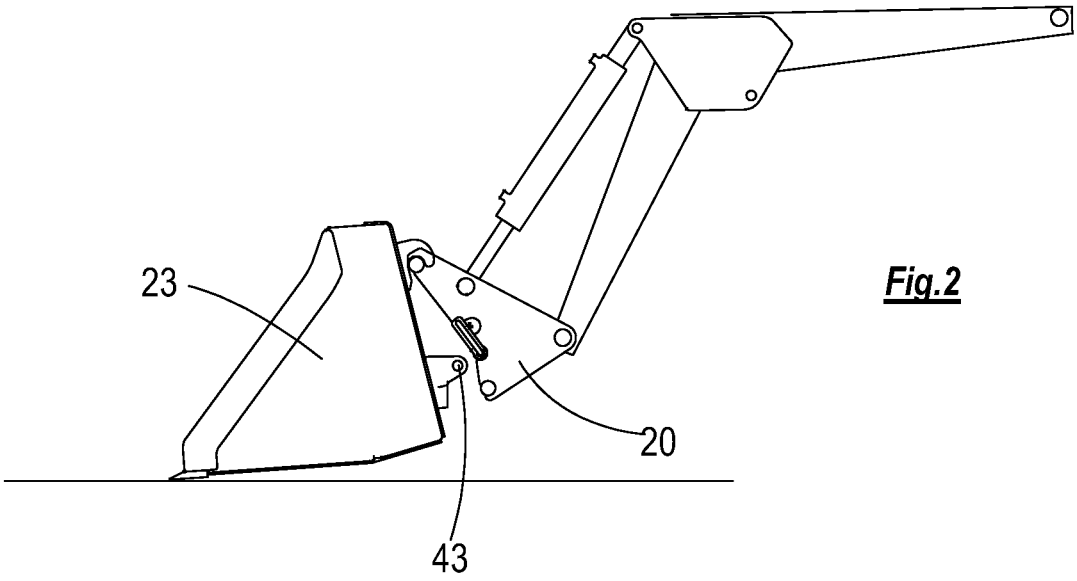
FIG. 2 is the same view as FIG. 1, except that a top-bucket-pin of the coupler is now engaged with a top-hook of the bucket.

In FIG. 1, the coupler 20 is attached into the end of the boom 21 of a tractor. The boom 21 can be manipulated by means of hydraulic controls located in the cab of the tractor. The driver is seeking to pick up a bucket 23. First, the driver manipulates the boom to bring a top-pin 25 of the coupler 20 up into a top-hook 27 of the bucket 23 (FIG. 2). Then, the driver swings the coupler 20 to bring a bottom-pin 29 of the coupler into engagement with a bottom-lug 30 of the bucket 23. The coupler 20 automatically locks onto the bottom-lug 30, and the bucket 23 is now safely and securely attached to, and locked to, the boom 21, and the tractor can be driven away (FIG. 3).

The dispositions of the left and right top-hooks 27, and of the bottom-lugs 30, on the back face of the bucket 23, are shown in FIG. 4. (There are a number of standard layouts of hooks and lugs for detachable buckets.)

FIG. 5 shows the coupler 20, as a unit. In FIG. 5, the coupler unit has been detached from the boom 21. FIG. 6 shows the frame 32 of the coupler 20, which is fixed to the end of the boom 21. (There are no moving components in FIG. 6.) FIG. 7 shows a slider 34, being a component of the coupler. FIG. 7A is a close-up of a cam-unit 36 that is integral with a sidebar 38 of the slider 34. FIG. 8 shows a lever-assembly 40, which interacts with the cam-unit 36 in such manner as to enable the bucket 23 to be locked to, and released from, the coupler 20.

FIG. 9 shows the relative positions of some of the components of the coupler 20 and of the bucket 23, when the coupler and the bucket are in their relative operational positions, but the coupler has just been unlocked, ready for the bucket to be released. That is to say, a handle 41 of the slider 34 has been manually pulled to the left, which has resulted in the bottom-pin 29 being withdrawn from the pin-hole 43 in the bottom-lug 30 of the bucket 23. (The right bottom-pin has been simultaneously withdrawn from the right bottom-lug of the bucket.)

FIG. 10 is the same view as FIG. 9, except that the lever-assembly 40 has been omitted. In FIG. 9, a lever 45 of the lever-assembly is interacting with the cam-unit 36 to hold the slider 34 in its withdrawn position, as shown. A lever-spring 47 biasses the lever 45 in the direction towards the cam-unit 36.

The coupler 20 includes a slider-spring 49, which connects the slider 34 to the frame 32, and biasses the slider 34 to move to the right. Thus, the slider-spring 49 urges the slider 34 towards the position in which the bottom-pin 29 of the coupler lies inside the pin-hole 43 of the bottom-lug 30—but, in FIG. 9, the lever 45 is held clear of the bottom-lug 30 by its interaction with the cam-unit 36.

In FIG. 11, the bottom-pin 29 of the coupler 20 is approaching the bottom-lug 30 of the bucket 23. The lever 45 is rotated to its down-position, under the urging of the lever-spring 47. The lever presses against the slider, and the slider, too, is urged to its down-position. The down-position of the lever, and the down-position of the slider, occur when the lever-spring (via the lever) urges the sidebar 38 of the slider against the bottom-wall 52 of the plate-aperture 54 in the inner-plate 56 of the frame 32. The tractor has been driven with the coupler in this FIG. 11 latched-open condition, in which the slider is automatically held in its pulled-out position. The coupler is in its latched-open condition also in FIGS. 1, 2, 5.

In FIG. 12A, the nose 50 of the bottom-lug 30 of the bucket 23 is entering the coupler, and has picked up the lever 45. The entering nose 50 causes the lever to rotate against the lever-spring 47, and to move towards its up-position. The lever has broken contact with the floor 61 of the channel of the cam-36 which is integral with the sidebar 38 of the slider.

FIG. 12B shows the bottom-lug 30 of the bucket now fully entered into the coupler. The lever has been pushed clear of the slider, leaving the slider free to move to the bucket-locked-in condition of the coupler. The coupler is in its bucket-locked-in condition also in FIG. 3.

The detailed sequence of operations and interactive movements of the components, which take place when the bucket is being picked up and locked, will now be described with reference to FIG. 13. FIG. 13 contains ten diagrams that show the progress of the movements of the components—from the bucket-locked-in condition of FIG. 13 view-A to the ready-to-receive-a-new-bucket latched-open condition of FIG. 13 view-J.

In FIG. 13 (and also FIG. 14) symbols have been placed alongside most of the diagrams.

(a) The box-with-knobs symbol indicates that the bucket is on the ground, and the driver is in the cab of the stationary tractor, using the hydraulic servo controls to manipulate the boom to attach/detach the bucket.

(b) The steering-wheel symbol indicates that the driver is driving the tractor and able to perform other tasks (with or without the bucket being coupled to the boom).

(c) The hand-symbol indicates that the bucket is resting on the ground, and the driver is down from the cab of the tractor and is manually manipulating the handle 41 of the coupler unit (including pulling/releasing the handle and/or rotating the handle).

The arrows in several of the views show that the indicated component has moved with respect to its position in the previous view.

In view-A of FIG. 13, the bucket 23 is resting on the ground, still locked to the coupler, but ready to be detached. The driver wishes to disengage the bucket 23 from the coupler 20 and from the boom 21.

View-A. The driver parks the tractor, the coupler 20 being in its bucket-locked-in condition, in which:

the slider-spring 49 urges the slider 34 rightwards, and the bottom-pin 29 of the slider 34 is locked in the lug-hole 43 of the bottom-lug 30 of the bucket 23;

the cam-unit 36 of the slider 34 lies to the right of the inner-plate 56;

the lever 45 is urged (downwards in FIGS. 13, 14) towards the sidebar 38 by the lever-spring 47, but the nose 50 of the bottom-lug 30 holds the lever 45 clear of the cam-unit 36 and the rest of the sidebar 38.

View-B. The driver gets down from the cab, and takes the handle 41 in hand, and rotates the slider 34, ensuring that the cam-unit 36 will clear the plate-aperture 54 in the inner-plate 56.

(In FIGS. 13, 14, rotational movement of the sidebar 38, about the axis of the bottom-pin 29, is represented as up/down movement of the sidebar 38.)

View-C. The driver pulls the handle 41 out (i.e. to the left), against the slider-spring 49:

the slider 34 moves leftwards, placing the cam-unit 36 to the left of the inner-plate 56, and pulls the bottom-pin 29 out of the lug-hole 43 in the bottom-lug 30 of the bucket 23 and the right bottom-pin out of the right bottom-lug.

The lever-spring 47 urges the lever 45 towards the sidebar 38, but the bottom-lug 30 continues to hold the lever 45 away from the sidebar 38.

Although now unlocked, the bucket 23 has not (yet) moved out of its as-locked position, whereby the lever 45 remains out of contact with cam-unit 36 and the sidebar 38.

View-D. With the handle 41 pulled out, the driver rotates the handle 41, so that, when the handle 41 is released, a plate-face 58 (see FIG. 7A) of the cam-unit 36 will engage the inner-plate 56 whereby the cam-unit 36 cannot now pass through the plate-aperture 54 of the inner-plate 56.

View-E. The driver releases the handle 41, so the slider 34, urged by the slider-spring 49, moves to the right until the plate-face 58 of the cam-unit 36 abuts the inner-plate 56.

The slider-spring 49 keeps the plate-face 58 tight against the inner-plate 56.

The bottom-lug 30 still has not moved, and continues to hold the lever 45 clear of the cam-unit 36.

View-F. The driver leaves the handle 41 in the condition as shown in view-E.

The driver—being now in the cab—operates the boom 21 to withdraw the coupler away from the bottom-lug 30 (see FIG. 2).

(In the views, the away-from-lug movement of the coupler 20 is represented as downwards movement of the bottom-lug 30.)

The lever 45, urged by the lever-spring 47, follows the downwards-movement of the bottom-lug 30, and the lever 45 now moves into a channel 60 of the cam-unit 36, to the left of the plate-face 58.

View-G. The driver moves the bottom-lug 30 further away.

The lever 45—urged by the lever-spring 47—follows the away-movement of the bottom-lug until the lever 45 contacts the floor 61 of the channel 60.

View-H. The driver continues to move the bottom-lug 30 further away, whereby the lever 45 and the sidebar 38 now rotate in unison, urged by lever-spring 47, and whereby the plate-face 58 of the cam-unit 36—urged by the slider-spring 49 into contact with the inner-plate 56—slides down the left side of the inner-plate 56.

View-I. The driver continues to move the bottom-lug 30 further away, and the lever 45, together with the sidebar 38, follow the movement until the plate-face 58 drops below a top-wall 63 of the plate-aperture 54 in the inner-plate 56, whereupon the cam-unit 36 enters the plate-aperture 54, as the slider-spring 49 urges the slider 34 to the right, until a lever-face 65 of the cam-unit contacts the lever 45, which halts the slider 34 in its rightwards movement.

View-J. The driver moves the bottom-lug 30 now clear of the coupler, the lever 45 and the sidebar 38 follow the movement, until the sidebar 38 rests against the bottom-wall 52 of the plate-aperture 54.

Now, the nose 50 of the bottom-lug 30 of the bucket 23 breaks contact with the lever 45.

(The coupler is now in its latched-open condition.)

The driver manipulates the boom 21 to unhook also the top-pin 25 of the frame 32 of the coupler from the top-hook 27 of the bucket 23.

Now, the coupler is free of the bucket 23, and the driver drives the tractor off to its next assignment, leaving the bucket 23 resting on the ground.

It will be understood that, in View.H and View.I, the rotational movement of View.H and the rightwards movement of View.I, under the urging of the slider-spring 49 and the lever-spring 47, take place more or less simultaneously, rather than sequentially. Also, it should not be regarded that the driver deliberately performs the movements depicted in Views.F,G,H,I separately and sequentially. Rather, the driver simply carries out the one single manipulation of the boom, in which the driver moves the coupler away from the bucket 23. This one manipulation automatically performs the operations shown by the sequence from View.F to View.J, and leaves the bucket 23 resting on the ground.

After the bucket 23 has been detached, the tractor can be driven with no accessory attached. The coupler remains in its latched-open-condition, as shown in FIG. 13, View.J. In this condition, the slider-spring 49 acts to urge the lever-face 65 of the cam-unit 36 into forceful contact with the lever 45. At the same time, the lever-spring 47 urges the slider 34 into contact with the bottom-wall 52 of the plate-aperture 54 in the inner-plate 56—whereby the coupler 20 remains in the latched-open condition, until it is time for the coupler again to be attached to a bucket or other accessory.

The operation of picking-up and locking a bucket into the coupler will now be described in relation to FIG. 14 and to the six Views.K to P thereof.

View.K. This is the same view as View.J of FIG. 13. The coupler is in its latched-open condition. There is no bucket 23 attached to the coupler.

The driver can drive the tractor:

the slider-spring 49 urges the slider 34 to the right, but the coupler is held in its latched-open condition by the engagement of the lever-face 65 of the cam-unit 36 against the lever 45.

It should be noted that the engagement of the lever-face 65 of the cam-unit 36 against the lever 45 means that a top-ledge 67 of the plate-face 58 of the cam-unit 36 lies within the plate-aperture 54 of the inner-plate 56.

View.L. Now, the driver has positioned the tractor adjacent to the new bucket to be attached, and the driver has manipulated the boom 21 to hook the top-pin 25 of the coupler into the top-hook 27 of the new bucket 23.

The driver now manipulates the boom 21 to bring the bottom-pin 29 of the coupler into alignment with the lug-hole 43 in the bottom-lug 30 of the bucket 23.

whereby the lever 45 touches the nose 50 of the bucket-lug.

View.M. The driver continues to move the coupler to press the lever 45 against the bottom-lug 30, moving the lever 45 against the lever-spring 47.

The slider-spring 49 urges the lever-face 65 of the cam-unit against the lever 45, and the sidebar 38 and the lever 45 move upwards together, such that the sidebar 38 breaks contact with the bottom-wall 52 of the plate-aperture 54.

The movement of the sidebar 38 continues until the top-ledge 67 of the cam-unit 36 engages the top-wall 63 of the plate-aperture 54, thereby blocking further upwards-movement of the sidebar 38, but the lever 45 can continue to move upwards.

View.N. The driver continues to move the coupler to press the lever 45 further against the bottom-lug 30, moving the lever 45 upwards against the lever-spring 47.

Now, the left-side of the lever 45 slides up the lever-face 65 of the now-stationary cam-unit 36.

View.O. The driver continues to move the coupler to press the lever 45 further against the nose 50 of the bottom-lug 30, moving the lever 45 against the lever-spring 47.

Now, the lever 45 breaks free of, and moves clear of, the lever-face 65 of the cam-unit 36.

View.P. From the position shown in View.K until View.O, the slider 34 was blocked from moving rightwards, by the engagement of the lever-face 65 of the cam-unit 36 against the left side of the lever 45.

Now, with this block removed, the slider 34, urged to the right by the slider-spring 49, moves rightwards, driving the bottom-pin 29 into the bottom-lug 30 (and the right bottom-pin into the right bottom-lug).

Now, the driver can drive off, the new bucket being safely and securely coupled and locked to the boom of the tractor.

The importance will now be explained, of the fact that the cam-unit 36 has two abutment faces, being:

1) the plate-face 58 which can contact the left side of the inner-plate 56, and thereby can hold the slider 34 from moving to the right, and 2) the lever-face 65 which can contact the left side of the lever, and thereby equally can hold the slider 34 against rightwards movement.

The layout of the components is such that, when the driver pulls the slider 34 to the left, the driver can rotate the slider until the plate-face 58 overlies the portion of the left side of the inner-plate 56 that lies above the top-wall 63 of the plate-aperture 54. This rotational movement is the movement between View.O and View.D of FIG. 13. Then, when the driver releases the slider, the slider-spring urges the plate-face 58 into contact with the inner-plate 56. This release movement is the movement between View.D and View.E of FIG. 13.

The driver leaves the coupler in the condition shown in View.E, and gets back into the cab, and commences to manipulate the boom to withdraw the coupler from the bucket (View.F). As the driver withdraws the coupler, the lever-spring 47 urges the lever into contact with the floor 61 of the channel 60 of the cam-unit (View.G). In View.H the lever has travelled far enough, downwards, that the plate-face 58 breaks contact with the side of the inner-plate 56. Consequently, the cam-unit (and the slider as a whole) move to the right, urged by the slider-spring 49.

But, at this point, the lever 45 occupies the channel 60 of the cam-unit 36. Therefore, the slider moves only a short distance rightwards, until the lever-face 65 contacts the lever 45.

Thus, as the coupler is progressively withdrawn from the bucket-lug 30 (View.F to View.I), at first the plate-face 58 holds the slider against rightwards movement, and this condition obtains until the lever is moved into the channel 60. Now, the continuing downwards rotation of the lever, and the slider, releases the plate-face from the inner-plate. Now, the lever-face 65 takes over the task of holding the slider 34 against rightwards movement. Thus, in View.J, the slider is retained in its pulled-out position; rightwards movement of the slider is prevented by the presence of the lever 45 in the channel 60, in that the presence of the lever in the channel blocks the slider from moving rightwards, whereby the coupler is left in its latched-open condition, set ready to accept another bucket.

The task of transferring the blocking function from the plate-face 58 to the lever-face 65 is accomplished simply by moving the coupler progressively away from the bottom-lug of the bucket.

Thus, the coupler remains in its latched-open condition until the lever 45 is rotated upwards, out of contact with the lever-face 65 of the channel—which is what happens when the bottom-lug of the next bucket enters the coupler.

When the next bucket is to be picked up, the task of releasing the slider from the lever-face 65 of the cam-unit, and of engaging the bottom-pin 29 into the lug-hole 43 of the new bucket, is accomplished simply by moving the coupler progressively onto the nose 50 of the bottom-lug 30 of the new bucket. The nose 50 of the bucket-lug moves the lever 45 (i.e. pushes the lever to rotate the lever towards its up-position in FIGS. 13, 14) until the lever breaks clear of the channel 60 and of the lever-face 65, whereupon the slider moves to the right.

The designer arranges the configurations of the components such that the bottom-pin 29 is aligned with the lug-hole 43, at the moment when the lever 45 breaks free of the lever-face 65, and emerges from the channel 60.

Thus, in order to release the bucket from the coupler, the driver simply pulls the handle, and sets the slider as in View.E of FIG. 13. The driver then simply manipulates the boom to withdraw the coupler from the bucket. To pick up a new bucket, the driver parks the tractor in front of the bucket, and simply manipulates the boom as in FIGS. 1, 2, 3, without needing to get down from the cab, and the bucket is not only picked up, but is securely locked to the coupler.

As mentioned, the coupler described herein is capable of carrying out its various tasks and operations without the need for a power source—apart from the need to re-energize the springs. The energy needed to re-energize the lever-spring comes from the force supplied by the tractor to move the boom, to cause the bottom-lug to enter the coupler. The energy needed to re-energize the slider-spring is supplied by the driver, upon pulling the slider to the right.

In an alternative coupler, the coupler is designed to enable the operations of picking up the bucket, locking the bucket in, unlocking the bucket, and detaching the bucket from the coupler, all to be performed by the driver, by operating the boom controls in the cab of the tractor. However, this degree of full automation requires a prime-mover, i.e. a powered creator of mechanical movement, actually on the coupler. (It will be understood that the coupler technology that is depicted and described herein does not have full automation in this sense, and in particular it does not have a powered prime-mover actually on the coupler.)

Full automation, though easy enough to provide, can be expensive, and is not the preferred option. It is recognized that the less-than-full degree of automation described herein—which stops short of including a powered prime mover actually on the coupler—provides a very favourable compromise between (expensive) full automation and the (inefficient) smaller degrees of automation that can be seen in prior art couplers.

In the examples described herein, the coupler carries out its mechanical operations by releasing energy that is stored on the coupler in e.g. a mechanical spring (e.g. the slider-spring 49). The release of energy stored in the spring is controlled within and by the coupler, which is arranged to trigger the release at the correct moment. If a powered prime mover were provided, its function could be arranged to be to supply the energy that is needed in order to re-set the coupler, i.e. to re-energize the spring or springs.

Of course, full automation can take more expensive forms, in which the designers provide many hydraulic rams, position-sensors, feedback loops, and so on. One of the benefits of the present technology is that there is no need for a powered prime-mover actually on the coupler, in that the driver can very easily re-energize the slider-spring, by manual manipulation of the slider handle. Of course, the driver has to get down from the tractor to do this. However, the time taken is small, and the overall reduction in efficiency can be regarded as trivial; thus, designers might well consider that stopping short of full automation is worth it, to avoid the need for introducing hydraulic components actually onto the coupler.

On the other hand, providing powered hydraulic equipment on tractors is a common everyday thing. Providing just one hydraulic ram, one control-valve, and one set of feed-return lines is as simple as it gets, when it comes to providing automated power. One option for providing full automation would be to provide the power source in the form of a hydraulic ram mounted on the coupler, and operating the ram to re-energize the springs.

It is preferred, therefore, not to implement full automation of the pick-up and put-down tasks, but to arrange for the human driver to provide the input of energy required in order to re-energize the springs, and to re-set the coupler to the latched-open position. Now, the coupler is primed and ready for the task of picking-up and locking-in the next bucket—automatically. Thus, it is arranged that, when the time comes to detach the bucket, the driver gets down from the cab and pulls the slider to the left, by hand manipulation. The driver also rotates the slider. These actions, as described, re-energize the slider-spring, and re-set the various components to the positions they need to be in to enable the coupler to perform the various tasks as described.

Of course, when done manually, the task of re-energizing the coupler springs could be performed by someone other than the driver. The need to provide an assistant to do an occasional task can be a source of huge inefficiency. (An assistant would be needed if, for example, the equipment were so designed that an operation has to be carried out on the coupler simultaneously with the boom being operated by the driver.) (The fact that a piece of farm equipment would require an assistant to be available to perform a regular but small task, would generally count against the adoption of that piece of equipment.)

Besides, it is no bad thing for the driver to be required to pull the slider out by hand. The fact of doing so means that the driver inevitably checks regularly that the slider slides freely, and is not damaged, iced-up, caked with dirt, etc. Again, the driver only needs to get down from the cab in order to pull the slider out. This action releases the present bucket, and re-sets the coupler to its latched-open condition, ready to pick up the next bucket, which will take place at some point in the future. The driver does not need to get down from the cab in order to lock the bucket into the coupler, e.g. by inserting a pin; the locking operation is performed automatically on the next bucket simply as a consequence of the bottom-lug of the next bucket entering the coupler.

As the locking operation is completed, the slider moves to the right, and the bottom-pin 29 passes through the lug-hole. In fact, the slider-spring slams the slider quite violently to the right, creating a loud bang. The bang signifies that the next bucket has been fully and properly locked into the coupler, and the prudent driver will listen for the bang to signal the bucket-locked-in condition.

Some further aspects of the structure and operation of the coupler will now be discussed.

To release the bucket, the driver grasps the handle 41, and pulls the slider 34 to the left. Depending on the rotational (i.e. the up/down) position of the slider (and the handle), the cam-unit 36 might not clear the top-wall 63 of the plate-aperture 54—if so, the driver can (manually) rotate the handle until the cam-unit can pass freely through the plate-aperture 54 (FIGS. 13A-D).

Now, with the slider pulled fully to the left, the driver rotates the handle towards the up-position of the slider, such that the plate-face 58 of the cam-unit now cannot pass through the plate-aperture 54 (FIGS. 13D-E). Rather, the plate-face 58 of the cam-unit now abuts against the left side of the inner-plate 56. Thus, although the slider-spring 49 is urging the slider to move to the right, the slider is prevented from moving rightwards by the engagement of the right-facing plate-face 58 of the cam-unit of the slider with the left-side of the inner-plate 56 (FIGS. 13E-G). (At this point, the lever 45 is held clear of any engagement with the cam-unit 36 or any part of the slider, by the fact that the bottom-lug 30 of the bucket is present in the coupler, and the bottom-lug holds the lever clear of the cam-unit (FIG. 13E.)

Thus, the driver pulls the slider to the left, rotating the slider as required, until the plate-face 58 of the cam-unit is pressing against the left side of the inner-plate 56. Then, the driver lets go of the slider; at this time, the slider cannot move to the right, because the plate-face 58 is abutting the inner-plate 56. The driver resumes his seat in the tractor, and now manipulates the boom so as to withdraw the coupler from the bucket. FIGS. 13F-I show the bottom-lug moving out of the coupler. The lever 45, being urged downwards by lever-spring 47, moves, in unison with the bottom-lug, to its down-position.

During this movement of the lever 45 that results from the withdrawal of the bottom-lug, as shown in FIGS. 13F-G, the lever enters the channel 60 of the cam-unit, until the lever contacts the floor 61 of the channel 60. Now, as the bottom-lug is further withdrawn, the lever-spring not only moves the lever towards its down-position, but the lever, in pressing against the floor of the channel, in turn rotates the slider to its down-position. In fact, the down-position of the lever coincides with the down-position of the slider, which occurs when the sidebar 38 of the slider presses against the bottom-wall 52 of the plate-aperture 54 (FIGS. 13H-J).

As the withdrawal of the bottom-lug continues, the lever-spring 47 moves the lever 45 and the sidebar 38 together, to a point at which the tip 67 of the plate-face 58 breaks contact with the left side of the inner-plate 56. Now, the slider being urged rightwards by the slider-spring, the plate-face of the cam-unit 36 is free to pass rightwards through the plate-aperture 54. However, the slider can move only a small distance rightwards, because the lever 45 lies in the path of the lever-face 65 of the cam unit. (This small distance that the slider moves rightwards is shown in the transition from FIG. 13H to FIG. 13I).

Thus, when the bottom-lug 30 is clear of the coupler, although the plate-face 58 no longer blocks the slider from moving rightwards, the task of blocking the slider from moving rightwards has been taken over by the engagement of the lever-face 65 against the lever 45. Thus, the act of withdrawing the coupler from the bottom-lug of the bucket still leaves the slider 34 blocked against rightwards movement—but now the agent that blocks the slider is the engagement of the lever-face 65 against the lever 45.

In FIGS. 13I-J, it can be seen that the tip 67 of the plate-surface 58 of the cam-unit now resides inside the plate-aperture 54. This arrangement can be beneficial for the following reason. In FIGS. 14M-O, the tip 67 actually engages the top-wall 63 of the plate-aperture 54, whereby the slider is blocked against rotating to its up-position. During the movements shown in FIGS. 14M-O, the force exerted by the slider-spring is reacted by the contact between the lever 45 and the lever-face 65 of the cam-unit. In FIGS. 14M-O, of course there is relative movement between these two components, and the resulting friction will or might tend to drag the slider to rotate towards its up-position. If the slider were allowed to rotate that far, during this phase of movement, the slider would or might not be able to move to the right, at all, i.e. the slider could not enter its bucket-locked-in condition. The mentioned benefit is that the engagement of the tip 67 against the top-wall 63 of the plate aperture prevents the slider from rotating that far.

Some of the terms and expressions used herein are illustrated and defined as follows.

The slider-left position of the slider is shown in FIGS. 1, 2, 5, 9, 10, 11, 12A, 13C-J, 14K-O. The slider-right position is shown in FIGS. 3, 12B, 13A-B, 14P. None of the drawings show the slider in an intermediate position while it is undergoing left/right movement.

In its slider-up rotational position, the slider is blocked from passing through the plate-aperture 54 in the frame. The slider-up position of the slider is shown in FIGS. 1, 2, 5, 13A,D-G, 14N-P. In its slider-down rotational position, the lever-spring 47 presses the slider down against the bottom-wall 52 of the plate-aperture 54. The slider-down position is shown in FIGS. 12A-B, 13B-C,H-J, 14K-L.

An intermediate up/down rotational position of the slider is shown in FIG. 14M-P. If, when the slider is in its slider-left position and in its intermediate up/down position, the lever is in its lever-up position, the slider is free to move to its slider-right position. If, when the slider is in its slider-left position and in its intermediate up/down position, the lever is in its lever-down position, the slider is blocked by the lever from moving to its slider-right position.

The lever-up rotational position of the lever is shown in FIGS. 3, 12B,1 3A-E. The lever-down rotational position of the lever is shown in FIGS. 1, 2, 5, 9, 11, 13I-J, 14K (where the lever 45 is clear of the nose 50 of the bottom-lug 30 of the bucket.) FIGS. 12A, 13F-H, 14L-O show the lever moving between the lever-down and lever-up positions.

The coupler is capable of adopting three conditions:

(1) the slider-held condition, in which the bottom-lug is entered in the coupler, the slider is in its slider-left and slider-up positions, the lever is in its lever-up position, and the frame-abutment engages the frame. (FIGS. 13E-G)

(2) the latched-open condition, in which there is no bottom-lug in the coupler, the slider is in its slider-left and slider-down positions, the lever is in its lever-down position, and the lever-abutment engages the lever. (FIGS. 1, 2, 5, 11, 13I-J)

(3) the accessory-locked-in condition, in which the bottom-lug is locked into the coupler, the slider is in its slider-right and slider-up positions, the lever is in its lever-up position, and both abutments are disengaged. (FIGS. 3, 12B, 13A, 14P)

The coupler is in its accessory-locked-in condition when the bottom-pin lies inside the lug-hole of the bucket or other accessory, the lever is in its lever-up position, and the slider is in its slider-up position and in its slider-right position (FIGS. 3, 12B, 13A, 14P).

The coupler is in its latched-open condition when no accessory is present, the slider is in its slider-left position and in its slider-down position, and the lever is in its lever-down position. (FIGS. 13J, 14K)

In the several views of FIG. 13, View.A shows the coupler in its accessory-locked-in condition. Views.B-D show the coupler being changed from its locked-in condition to its slider-held condition. View.E shows the coupler in its slider-held condition. Views.F-H show the coupler being changed from its slider-held condition to its latched-open condition. Views.I-J show the coupler in its latched-open condition.

In View.F, the bottom-lug of the bucket is starting to be withdrawn, which enables the lever and the slider to rotate downwards, and thereby allows the coupler to change from its slider-held condition to its latched-open condition. The change to the latched-open condition has been completed in View.I.

In the several views of FIG. 14, View.K shows the coupler in its latched-open condition. Views.L-O show the bottom-lug of the accessory entering the coupler, and pushing the lever and the slider progressively upwards, until the lever breaks clear of the lever-abutment (View.O). Now, the slider-spring slams the slider to its slider-right position, putting the coupler into its accessory-locked-in condition. View.P shows the locked-in condition.

The slider-left position is the position of the slider when the coupler is in its slider-held condition, and when the coupler is in its latched-open condition. The slider-right position is the position of the slider when the coupler is in its accessory-locked-in condition.

In the drawings, the plate-face 58 serves as a right-facing lever-abutment, and the lever-face 65 serves as a right-facing frame-abutment. Both are components of the cam-unit 36, which is integrated into the slider 34.

Preferably, the direction of the up/down mode of movement of the slider should be substantially at right angles to the direction of the left/right mode of movement (as in the drawings). Thus, the up/down movements of the slider (and of the lever) can take place independently of, and without affecting, the left/right movements of the slider—and vice versa.

An important safety /security aspect will now be described. It will be noted that the lever-spring 47 only starts to exert its force on the slider, to push the slider towards its down-position, when (i.e. after) the lever has made contact with the floor 61 of the channel 60 of the cam-unit. Thus, the plate-face 58 of the cam-unit cannot even start to move free of its contact with the inner-plate 56, until the lever has entered the channel 60 and the lever-spring 47 is pressing the lever against the floor 61 of the channel. It follows that, in the latched-open condition of the coupler, the lever is bound to be in contact with the floor of the cam-unit. Again, the blocking effect of the plate-face 58 against the plate 56 can only start to be released when (i.e. after) the lever has made full contact with the floor 61 of the channel 60 of the cam-unit. The safety aspect that arises from this fact can be understood as follows.

It will be understood that, when the coupler has been withdrawn from the bucket, the tractor can now be driven normally, but without a bucket or other accessory being attached to the boom. In fact a considerable time may elapse before the tractor driver has occasion to pick up the next bucket. The designers should see to it that, during that time, the latched-open condition (being the stored energy-condition) of the coupler remains intact. Designers will recognize the possibility that the lever, inadvertently or accidentally, might move clear of the lever-face 65, and thus trigger the slider-spring to pull the slider rightwards—for example if the coupler were to be subjected to a heavy jar. It is recognized that the chances of the lever being jarred clear of the lever-face might or would be dangerously high if the lever were to be only partly in contact with the lever-face, i.e. if the lever were not pressed firmly against the floor of the channel. Thus, the fact that the plate-face 58 cannot start to move clear of the left side of the inner-plate 56 until the lever is touching the floor 61 of the channel, makes it (almost) impossible for this dangerous condition to occur.

The reason it might be dangerous if the coupler were to lose its latched-open condition, prior to the next bucket being picked up, is that the driver might not notice the loss of the latched-open condition. If that happened, it might be possible for the driver, upon picking up the next bucket, to think that the bucket has been attached and securely locked into the coupler, whereas in fact the bucket is only precariously resting on the coupler—which of course would be very dangerous. Again, the fact that the lever is fully in position to block rightwards movement of the slider, before the plate-face 58 has even started to move out of its blocking position, removes the danger.

Some further details of the operation of the coupler will now be described.

In the depicted coupler 20, the driver puts the coupler into its slider-held condition (View.E) by manually manipulating the coupler. To do this, first the driver pulls the handle 41 and moves the slider 34 to its slider-left position. At this time, in order for the cam-unit 36 of the slider to pass through the plate-aperture 54 in the inner-plate 56 of the frame, the driver rotates the slider to its slider-down position (View.B).

Once the cam-unit has passed through the plate-aperture 54, the driver rotates the slider upwards to its slider-up position (View.D). Now, the slider cannot pass through the plate-aperture 54; rather, the driver having released the slider, the slider starts to move rightwards under the force of the slider-spring 49—but the plate-face 58 engages against the left side of the inner-plate (View.E), which blocks the cam-unit, and the slider, from moving rightwards away from its slider-left position.

Thus, in the slider-held condition of the coupler (View.E), the lever 45 plays no part in holding the slider in its slider-left position. In the slider-held condition, the bottom-lug 30 is still present within the coupler, and the nose of the bottom-lug holds the lever in its lever-up position. In the slider-held condition of the coupler, it is the engagement of the plate-face 58 of the cam-unit 36 against the left side of the inner-plate 56 that holds the slider in its slider-left position, against the action of the slider-spring 49.

The slider-held condition of the coupler (View.E) is a temporary condition. In both the slider-held condition and the latched-open condition (View.J), the slider is blocked from moving rightwards, under the action of the slider-spring. In the slider-held condition, the slider is blocked by the engagement of the plate-face 58 with the left side of the plate 56 of the frame; in the latched-open condition (View.J), the slide is blocked by the engagement of the lever-face 65 with the left side of the lever 45.

One function of the slider-held condition (View.E) is to hold the slider in its slider-left position temporarily, while the operation of separating the coupler from the bucket is being carried out—thereby putting the coupler into its full latched-open condition (View.J). The change from the slider-held condition of the coupler to the latched-open condition may be equated to the transfer of the blocking function from the engagement of the plate-face 58 of the cam-unit 36 against the left side of the plate 56, to the engagement of the lever-face 65 of the cam-unit against the left side of the lever. This is the change as shown in Views.F-J.

This change, from the slider-held condition to the latched-open condition, is accomplished entirely by the withdrawal of the bottom-lug 30 from the coupler (or rather, by the withdrawal of the coupler from the bottom-lug). That is to say, the driver does nothing in order to effect the change from the slider-held condition (View.E) to the latched-open condition (View.J), other than to manipulate the boom to separate the coupler from the bucket.

The coupler having been set into its slider-held condition, now the driver manipulates the boom, to move the bottom-lug out of the coupler. As the bottom-lug moves out, the lever rotates progressively towards its lever-down position (Views.F-J). The designers arrange for the first part of the downwards movement of the lever to move the lever fully into its blocking position, in which the lever now lies in the path of rightwards movement of the lever-face 65 (View.F-G).

With the lever established in this blocking position, the blocking task can now be transferred from the plate-face 58 to the lever-face 65. The designers arrange for this to be done by the second part of the downwards movement of the lever, as the bottom-lug continues to be withdrawn from the coupler. The descending lever having picked up the slider, the second part of the continuing downwards movement of the lever (under the action of the lever-spring) now also rotates the slider towards its slider-down position (Views.H-I).

In View.H, the slider has rotated far enough downwards that the top-ledge 67 is now below the top-wall 63 of the plate-aperture 54; i.e. the right-facing plate-face 58 of the cam-unit is no longer in abutting contact with the left side of the plate 56. The slider-spring urges the slider to move to the right, and the slider moves rightwards (Views.H-I) the short distance until the right-facing lever-face 65 of the cam-unit engages and abuts the left side of the lever 45.

Thus, in Views.I-J, the slider is still held in its slider-left position, but now the slider is so held by the lever-face 65 engaging the lever, rather than by the plate-face 58 engaging the frame.

Thus, the transfer or changeover has now been achieved, from the slider-held condition of the coupler (View.E) to the latched-open condition (View.J). In View.J, the bottom-lug of the bucket has been fully withdrawn from the coupler, and the coupler is in its latched-open condition, ready to pick up the next bucket.

When the time comes to pick up the next bucket or other accessory, again the task of picking up and securely locking the next bucket to the coupler is accomplished entirely by the entry of the bottom-lug of the next bucket into the coupler. That is to say, the driver does nothing in order to effect the change from the latched-open condition (Views.J, K) to the bucket-locked-in condition (View.P), other than to manipulate the boom to move the bottom-lug of the bucket into the coupler.

FIG. 15 shows a modification to the coupler. Here, a guide 69 has been added. The guide takes the form of a piece of sheet metal welded to the right side of the inner-plate 56. The guide follows the profile of the top-wall 63 of the plate-aperture 54 in the inner-plate 56 of the frame 32 of the coupler. The function of the guide may be explained as follows.

The cam-unit 36 includes the right-facing plate-face 58 and the right-facing lever-face 65, and is integral with the slider. The two promontories, upon which these right-facing faces are formed, are shown, in the drawings, with left-facing surfaces which lie at an angle to the direction of the left/right movement of the slider. When the driver comes to pull the slider to the left, the driver should first rotate the slider downwards, in order for the promontories of the cam-unit to pass freely through the plate aperture 54. If the driver forgets or otherwise leaves the slider in its slider-up position, while pulling the slider to the left, the intent is that the sloping left-facing surfaces will assist the driver in rotating the slider downwards. But even so, e.g. with an inexperienced driver, there can be some difficulty in rotating the slider in such manner as to enable the cam-unit to pass freely through the plate-aperture.

The guide 69 keeps the promontories within the profile of the top-wall 63 of the plate-aperture 54 at all times while the promontories lie to the right of the plate 56. This means that even new drivers will never have difficulty getting the slider into the right position so the promontories pass freely through the plate-aperture. The driver's task—of first pulling the slider to the left, and then rotating the slider to engage the plate-face 58 against the left side of the inner-plate 56—could hardly be simpler.

As mentioned, when picking up the next bucket, the driver manipulates the coupler so that the bottom-lug of the next bucket enters the coupler. The designers have seen to it that, as the bottom lug moves into the coupler, a nose of the bottom-lug engages the lever, and starts to move the lever. (In an alternative, the nose that engages and moves the lever is on a part of the slider other than the bottom-lug.)

The designers have harnessed the incoming movement of the bottom-lug, as the bottom-lug enters the coupler, as the agency that will trigger the release of the slider. Thus, the designers arrange for the incoming nose to move the lever far enough for the lever to clear the lever-abutment.

In the coupler as depicted, when the slider is in its left-position, and the lever is in its down-position, it is the engagement of the left side of the lever with the right side of the lever-abutment, that blocks the slider from moving rightwards. The designers have planned the structure of the coupler to harness the movement of the incoming bottom-lug to move the lever far enough, in its up direction, that the lever is finally pushed clear of the lever-abutment face on the cam unit of the slider. At that moment, the slider-spring slams the slider to its right-position (See FIG. 14, Views.O-P.)

The designers of course must see to it that, at the moment when the lever finally moves into its up-position, i.e. moves far enough to clear the lever-abutment, thereby releasing the slider, that the bottom-pin of the slider is, at that moment, aligned with the lug-hole in the bottom-lug of the bucket.

It is important not to release the slider too soon, nor too late, in that the bottom-pin would or might then 'miss' the lug-hole. However, there is no need for the bottom-pin to be a tight fit in the lug-hole, and the designers can readily plan the size of the lug-hole to provide a large enough clearance on the bottom-pin to allow for normal manufacturing inaccuracies and misalignments.

Thus, it is an easy matter for the designers to ensure that the lug-hole is always sufficiently well-aligned with the bottom-pin, at the moment of release of the slider, that the bottom-pin never misses the lug-hole, but always enters the lug-hole with clearance to spare. In FIG. 14, View.M shows the bottom-pin grossly mis-aligned with respect to the lug-hole—but in View.M, of course the lever is still fully engaged with the lever-abutment of the slider.

FIG. 14 View.N shows the bottom-pin almost, but not quite, aligned with the lug-hole. In View.N, similarly the lever is almost, but not quite, out of engagement with the lever-abutment of the cam-unit, i.e. the engagement is not now so full as it was in View.M.

FIG. 14 View.O shows the critical point at which the slider is just about to be released. The designers need to make sure that the slider does not release until the bottom-pin is well-enough aligned with the lug-hole. It is recognized that, in the depicted coupler, it is a simple task for the designers to do this.

Terms of orientation (e.g. "up/down", "left/right", and the like), when used herein, are intended to be construed as follows. The terms being applied to a device, that device is distinguished by the terms of orientation only if there is not one single orientation into which the device, or an image (including a mirror image) of the device, could be placed, in which the terms could be applied consistently.

The numerals used in the drawings can be summarized as:

20 coupler
21 boom
23 bucket
25 top-pin of the coupler
27 top-hook of the bucket
29 bottom-pin of the coupler
30 bottom-lug of the bucket
32 frame of the coupler
34 slider of the coupler
36 cam-unit of the
38 sidebar of the slider
40 lever-assembly of the slider
41 handle of the slider
43 lug-hole in the bottom-lug of the bucket
45 lever
47 lever-spring
49 slider-spring
50 nose of the bottom-lug of the bucket
52 bottom wall of the
54 plate-aperture in the
56 inner-plate of the frame
58 plate-face of the cam-unit
60 channel of the cam-unit
61 floor of the channel of the cam-unit
63 top-wall of the plate-aperture in the inner-plate
65 lever-face of the cam-unit
67 top-ledge of the cam-unit
69 guide for the cam-unit.

The scope of the patent protection sought herein is defined by the accompanying claims. The apparatuses and procedures shown in the accompanying drawings and described herein are examples.

The invention claimed is:

1. A tool attachment coupler, wherein:

the coupler is structured for:

a) fixation to the boom of a manipulable-boom-tractor;

b) attachment and detachment of a tool to and from the boom; and c) maintaining the tool in a securely-attached condition with respect to the boom during operation of the tool on the tractor;

the tool includes a top-hook and a bottom-lug for interaction with the coupler;

the coupler includes:

a) a frame, by which the coupler is fixed to the boom;

b) a slider mounted and guided in the frame for left/right movement relative to the frame between a slider-left position and a slider-right position; and c) a slider-spring, which biases the slider to its slider-right position;

the slider includes a bottom-pin, which passes through a lug-hole in the bottom-lug thereby locking the tool to the boom when:

a) the bottom-lug is engaged in the coupler, and b) the slider is in its slider-right position;

the slider is guided in the frame for up/down movement relative to the frame between a slider-up position and a slider-down position;

the coupler includes:

a) a lever, mounted and guided in the frame for up/down movement relative to the frame between a lever-up position and a lever-down position; and b) a lever-spring, which biases the lever to its lever-down position;

the slider is provided with a right-facing abutment, which is so configured that:

a) the slider being in its slider-left and slider-up positions, and the lever being in its lever-up position, the right-facing abutment engages the frame, thereby blocking the slider from undergoing rightwards movement;

b) the slider being in its slider-down position, the right-facing abutment then is clear of the frame, freeing the slider to undergo rightwards movement;

c) the slider being in its slider-down position, and the lever being in its lever-down position, the right-facing abutment engages the lever, thereby blocking the slider from undergoing rightwards movement;

d) the lever being in its lever-up position, the right-facing abutment then is clear of the lever and of the frame, freeing the slider to undergo rightwards movement;

whereby the slider is free to undergo rightwards movement to its slider-right position when both a) the slider is in its slider-down position, and b) the lever is in its lever-up position;

and whereby the slider is blocked from undergoing rightwards movement to its slider-right position:

a) when the slider is in its slider-up position, and b) when the lever is in its lever-down position;

the coupler is in a tool-locked-in condition when:

a) the bottom-pin is in the lug-hole of the tool, b) the slider is in its slider-up and its slider-right position, and c) the lever is in its lever-up position;

the coupler is in a slider-held condition when:

a) the bottom-lug is entered in the coupler, b) the slider is in its slider-left and slider-up positions, c) the lever is in its lever-up position, and d) the right-facing abutment engages the frame;

the coupler is in a latched-open condition when:

a) no bottom-lug is present in the coupler, b) the slider is in its slider-left and its slider-down position, c) the lever is in its lever-down position, and d) the right-facing abutment engages the lever.

2. A tool attachment coupler as claimed in claim 1, wherein:

the coupler being in its tool-locked-in condition, the coupler is structured to enter its slider-held condition responsively to the slider being moved leftwards to its slider-left position against the force of the slider-spring;

the coupler being in its slider-held condition, the coupler is structured to enter its latched-open condition, responsively to the coupler being withdrawn from the bottom-lug of the accessory;

the coupler being in its latched-open condition, the coupler is structured to enter its accessory-locked-in condition, responsively to a bottom-lug of another tool being inserted into the coupler.

3. A tool attachment coupler as claimed in claim 2, wherein the coupler is so structured that the slider is capable of being moved by manual hand action:

a) from its slider-right position to its slider-left position, and b) from its slider-down position to its slider-up position.

4. A tool attachment coupler as claimed in claim 1, wherein:

the up/down movement of the slider includes a rotational movement about a slider-pivot fixed into the frame of the coupler; and the up/down movement of the lever includes rotational movement about a lever-pivot fixed into the frame of the coupler.

5. A tool attachment coupler as claimed in claim 4, wherein the up/down mode of movement of the slider is substantially at right angles to the left/right mode of movement.

6. A tool attachment coupler as claimed in claim 1, wherein the slider is so structured in relation to the bottom-lug, that:

the slider being in its slider-left and slider-down positions, and the lever being in its lever-down position, the bottom-lug of the tool is free to enter the coupler;

entry movement of the bottom-lug into the coupler, engages the lever in its lever-down position, and moves the lever towards its lever-up position, until:

a) the lever moves clear of the right-facing abutment, and b) the lug-hole in the bottom-lug is aligned with the bottom-pin of the slider;

c) whereupon, the slider moves rightwards to its slider-right position, and the bottom-pin enters the lug-hole thereby latching the coupler to the bottom-lug of the tool.

7. A tool attachment coupler as claimed in claim 1, wherein:

the slider-spring is increasingly biased by the action of the slider being forcefully moved towards its slider-left position from its slider-right position;

the lever-spring is increasingly biased by the action of the bottom-lug pushing the lever against the lever-spring towards its lever-up position from its lever-down position.

8. A tool attachment coupler as claimed in claim 1, wherein:

the frame includes a plate having a left side;

the right-facing abutment is provided on a cam-unit of the slider, and includes a right-facing frame-abutment;

the right-facing frame-abutment of the cam-unit engages the left side of the plate when the right-facing abutment engages the frame;

the plate includes a plate-aperture structured:

a) to pass the slider, in its down-position, including the cam-unit, freely through the plate-aperture in the left/right direction;

b) to block the slider, in its up-position, from passing freely through the plate-aperture in the left/right direction, by the engagement of the frame-abutment of the slider against the left side of the plate.

9. A tool attachment coupler as claimed in claim 8, wherein:

the right-facing abutment also includes a right-facing lever-abutment, and the distance apart, in the left/right direction, of the right-facing frame-abutment and the right-facing lever-abutment is more than the distance apart of the left side of the lever and left side of the plate; and the resulting clearance is sufficient that, when the coupler is in its slider-held condition, the frame-abutment being engaged against the frame, the lever is held clear of the lever-abutment, and can move downwards relative to the lever-abutment.

10. A tool attachment coupler as claimed in claim 1, wherein:

the left/right movement of the slider is linear translational movement;

the up/down movement of the slider is rotational movement with the axis of the slider rotation aligned in the left/right direction coaxial with the axis of the bottom-pin;

the up/down movement of the lever is rotational movement with the axis of the lever rotation parallel to, and spaced apart from, the axis of the slider rotation.

11. A procedure for locking and unlocking a tool to and from the boom of a boom-tractor, including:

providing a coupler that embodies claim 1;

the coupler being secured to the boom of the tractor, and being in its latched-open condition, driving the tractor to the tool;

so manipulating the boom that the bottom-lug of the tool enters the coupler, whereby the coupler changes from its latched-open condition to its tool-locked-in condition;

carrying out assignments of the tractor with the tool attached and locked-in;

applying force to the slider to move the slider to the left, thereby changing the coupler from its tool-locked-in condition to its slider-held condition;

manipulating the boom to separate the coupler from the bottom-lug of the tool, thereby changing the coupler from its slider-held condition to its latched-open condition.

* * * * *